United States Patent [19]

Schmitz, Sr.

[11] 4,257,611

[45] Mar. 24, 1981

[54] DOMINOES WITH CONCEALABLE SPOTS

[75] Inventor: John N. Schmitz, Sr., 3324 N. Stanton, El Paso, Tex. 79902

[73] Assignees: Schmitz, Sr., John Nathaniel; Wanda Lee Wilcoxon Schmitz; Cynthia Elaine Schmitz; Rebecca Lee Schmitz McKenzie, all of El Paso, Tex.

[21] Appl. No.: 65,833

[22] Filed: Aug. 16, 1979

[51] Int. Cl.[3] ..... A63F 9/20

[52] U.S. Cl. ..... 273/293; 273/296

[58] Field of Search ..... 273/293, 146, 153 R, 273/281, 289, 296

[56] References Cited

U.S. PATENT DOCUMENTS

| | | | |
|---|---|---|---|
| 935,258 | 9/1909 | Immer | 273/281 X |
| 3,349,387 | 10/1967 | Sicard | 273/293 X |

FOREIGN PATENT DOCUMENTS

| | | | |
|---|---|---|---|
| 1312033 | 11/1962 | France | 273/289 |
| 1238 | of 1908 | United Kingdom | 273/153 R |

*Primary Examiner*—Anton O. Oechsle

[57] ABSTRACT

A domino construction, which includes rollers and gears within the main structure of the domino, which makes it possible to cause spots to disappear, when viewing the domino from the top side, without turning over the main structure of the domino. When the spots disappear from the top side of the domino body, they simultaneously appear at the bottom side. Time is saved during and between games because shuffling of the dominoes also takes care of the necessity of turning over the dominoes, or concealing the spots.

3 Claims, 8 Drawing Figures

FIG. 1
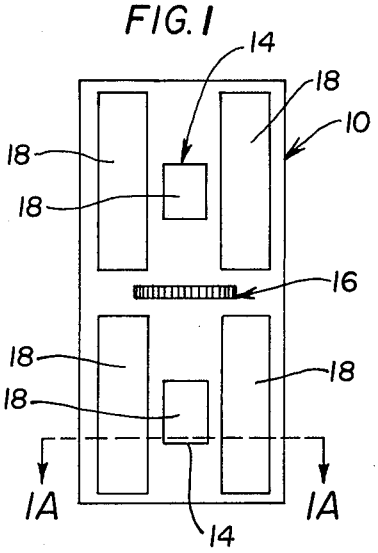
FIG. 2
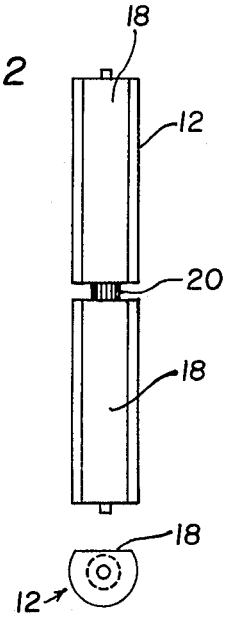
FIG. 2A
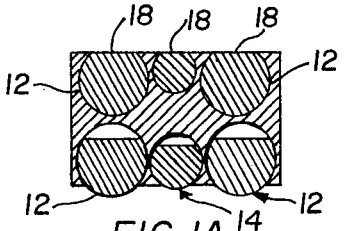
FIG. 1A
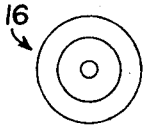
FIG. 3
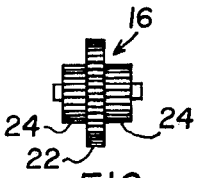
FIG. 3A
FIG. 4
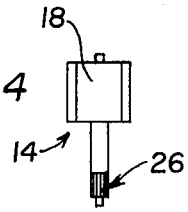
FIG. 4A
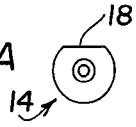

DOMINOES WITH CONCEALABLE SPOTS

SUMMARY OF THE INVENTION

The object of this improvement is to provide dominoes that are not turned over before the shuffle. The spots, or indicia, on the top side of the main structure of the domino can be caused to become concealed and during this procedure, spots on the opposite side of the main structure become visible when a player chooses the domino and places it on its edge in front of him. Time is not lost in turning over the dominoes during or between games.

BRIEF DESCRIPTION OF THE DRAWINGS

FIG. 1 is a top plan view of a domino made in accordance with the concepts of the present invention;

FIG. 1A—1A is a section taken generally along the line 1A—1A of FIG. 1;

FIG. 2 is a top plan view of one of the four outside rollers of the invention;

FIG. 2A is an end view of the roller of FIG. 2;

FIG. 3 is an end view of the central gear of the invention;

FIG. 3A is a side view of the central gear;

FIG. 4 is a top plan view of one of the inside rollers; and

FIG. 4A is an end view of the roller of FIG. 4.

DETAILED DESCRIPTION OF THE INVENTION

FIG. 1 shows the main structure of the domino 10 plus four outside rollers 12, four inside rollers 14 and a central gear 16. The spots, or indicia, of the dominoes will be painted or otherwise marked on the flat surface 18 of each roller where applicable.

FIG. 2 shows one of the four outside rollers 12 with the gear 20 in the middle of the roller 12. This gear 20 will mesh with the large gear 22 of the central gear 16.

FIG. 3 shows the central gear 16 which has one large gear 22 which meshes with gears 20 of the four outside rollers 12 and two small gears 24, one on each side of the large gear 22. Each small gear 24 meshes with the gears 26 of the two inside rollers 14.

FIG. 4 shows one of the inside rollers 14. It also has a flat surface 18 on which a spot can be placed, if applicable. The inside roller 14 has a slightly smaller diameter than the outside rollers 12 so that when the domino is placed on the table, only the outside rollers 12 will support the domino 10 and there should be a minimum of wobble.

OPERATION OF THE INVENTION

The dominoes are placed on a table and if any spots, or indicia, are turned up, shuffling of the dominoes will cause the outside rollers 12 to turn. As the outside rollers 12 turn, they will turn to the flat part 18 of the rollers 12 and 14 and then the domino will slide on the table. On the top side of the domino the round part of each roller will be above the main structure of the domino and all of the spots will be concealed. If the person shuffling the dominoes sees spots on some dominoes, he must move those dominoes in a side-ways direction, thereby causing the rollers to roll to the flat part 18 of the rollers 12 and 14. As the lower rollers 12 and 14 turn, the gears 20 on the rollers 12 turn the central gear 16 which in turn turns the upper rollers 12 and 14. The upper rollers 12 and 14 will also turn to a position with the flat surfaces 18 turned downward totally concealing the spots, or indicia, as viewed from the top of the domino.

The foregoing descriptions have been given for clearness of understanding only and no unnecessary limitations should be understood therefrom as some modifications will be obvious to those skilled in the art.

I claim:

1. A domino comprising a body having two major opposed flat surfaces, means for causing domino indicia to be selectively displayed in the plane of each of said surfaces, said means including means for ensuring that when said domino indicia are displayed on one of said surfaces no domino indicia are displayed on the other of said surfaces.

2. A domino comprising a body having two major opposed flat surfaces, first and second series of hollowed-out voids of cylindrical form paralleling respective ones of said flat surfaces and being of such depth as to intercept the respective surfaces, thus forming openings therein, a first and second series of cylindrical rollers rotatably disposed in said hollowed-out voids, said rollers each provided with flat and curved surface portions extending parallel to the axis of the cylinder, said rollers and said surface portions being so dimensioned with respect to said hollowed-out voids that when the rollers are disposed in respective ones of said voids with their curved portions extending outwardly such surface portions extend through the openings and beyond the corresponding flat surfaces of the domino body, and when the rollers are rotated so as to present their flat surface portions outwardly of the body, the flat surface portions are coplanar with the corresponding domino body surfaces and the rollers fill the voids in which they are disposed, and domino indicia displayed only on the flat surface portions of the rollers.

3. A domino as defined in claim 2 which further includes means interconnecting the rollers associated with one of said domino surfaces with those rollers associated with the other of said domino surfaces such that when the rollers associated with said one domino surface are rotated to dispose their flat surfaces outwardly the rollers associated with said other domino surface are rotated to dispose their curved surface portions outwardly, and vice-versa.

* * * * *